United States Patent [19]

Solomon

[11] 4,088,989

[45] May 9, 1978

[54] INTRUSION DETECTION APPARATUS

[75] Inventor: Elias E. Solomon, Duxbury, Mass.

[73] Assignee: Gulf & Western Manufacturing Company, New York, N.Y.

[21] Appl. No.: 638,683

[22] Filed: Dec. 8, 1975

[51] Int. Cl.[2] ..... G08B 13/04

[52] U.S. Cl. ..... 340/274 R; 340/261

[58] Field of Search ..... 340/261, 274 R, 258 A, 340/258 C, 258 D, 15; 310/8.1, 9.1; 73/70

[56] References Cited

U.S. PATENT DOCUMENTS

| | | | |
|---|---|---|---|
| 2,987,713 | 6/1961 | Bagno | 340/258 A |
| 3,697,989 | 10/1972 | Bailey et al. | 340/258 A X |
| 3,793,617 | 2/1974 | Tolman | 340/258 A X |
| 3,889,250 | 6/1975 | Solomon | 340/274 |
| 3,925,773 | 12/1975 | Green | 340/258 A |
| 3,946,377 | 3/1976 | Zetting | 340/274 R |

*Primary Examiner*—Glen R. Swann, III

*Attorney, Agent, or Firm*—Wolf, Greenfield & Sacks

[57] ABSTRACT

In an active system a transmitter transducer and a receiver transducer are both secured to an object such as a glass panel the intrusion through which is to be monitored. The transmitter transducer establishes a relatively low frequency signal in the panel and a supervisory branch which couples from the receiver transducer monitors the presence of this supervisory signal. A second branch which also couples from the receiver transducer is for monitoring intrusion and comprises digital circuitry including a pair of monostable multivibrators and a counter which counts pulses from one of the monostable multivibrations during a time interval determined by the other monostable multivibrator to discriminate between panel breakage and panel rapping, for example. The tampering with voltage lines is also detected and a special holder is employed for fastening the transducers to the panel.

11 Claims, 4 Drawing Figures

RECEIVE TRANS-DUCER
16
17
AMP. 1
18
FILTER
36
SCHMITT/ COMP-ARATOR 1
38
MONO-STABLE SIGNAL COND-ITIONER
40
WINDOW MONO-STABLE
42
48
47
RESET
ENABLE
46
CLOCK I/P
CL
R
COUNTER
O/P
E
44
n
BISTABLE 50
O/P
14
F1
TRANSMIT TRANS-DUCER
12
OSCILL-ATOR
10
19
AMP. 2
20
INTE-GRATOR 22
SCHMITT COMP-ARATOR 2
24
+V
27
26
L.E.D. 1
28
31
DELAY 30
SCHMITT/ COMP-ARATOR
32
SUPERVISORY ALARM O/P

FIG. 2
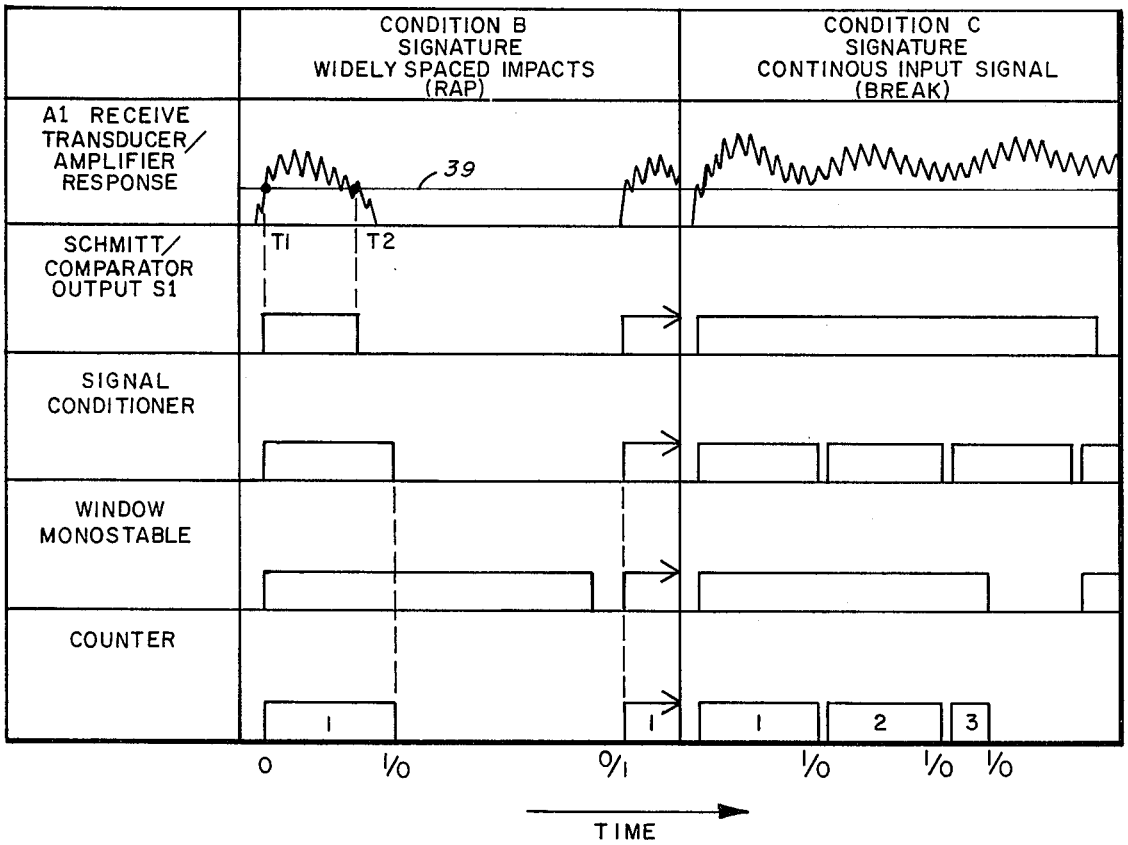
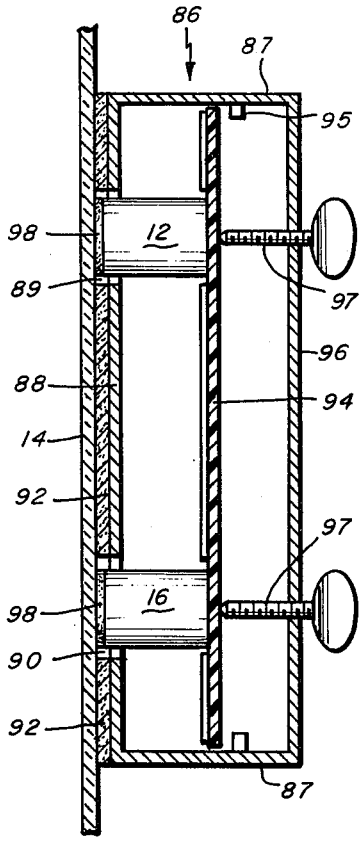
FIG. 4

INTRUSION DETECTION APPARATUS

BACKGROUND OF THE INVENTION

The present invention pertains in general to an apparatus or circuit for detecting intrusion. The present invention pertains, more particularly, to the signature recognition of intrusion by either passive or active digital techniques. Although the present invention may be practiced in connection with intrusion through any object, it is particularly concerned with the detection of breakage in a glass panel.

U.S. Pat. No. 3,889,250 describes an apparatus for detecting the breakage of glass windows and the like. This patent, in particular, shows a modulation-demodulation technique. In the present invention, on the other hand, there is described a detector which employs digital techniques and which may be used either in a passive system or an active system.

Accordingly, one object of the present invention is to provide an intrusion detection system employing digital detection techniques.

A further object of the present invention is to provide an intrusion detection system particularly adapted for detecting the breakage of glass or the like panels and which system is not susceptible to false alarm conditions.

It has been found that when the transducers are secured to the glass panel with the use of a solid substance such as in epoxy, that heat from the sun may cause tensions in the transducers creating a false alarm condition. It is suspected that as the glass expands, the transducer cannot expand therewith and thus signals are established which give a false indication of intrusion.

Accordingly, another object of the present invention is to provide a special holder for the transducers for urging the transducers against the panel or object and having a lubricant disposed between the panel and the transducer permitting free sliding therebetween in the event that the panel expands for any reason such as when the panel is subjected to heat from the sun.

Still another object of the present invention is to provide circuitry for also sensing a break in the voltage line or other tampering with the detection circuit.

SUMMARY OF THE INVENTION

To accomplish the foregoing and other objects of this invention there is provided an apparatus for detecting an intrusion into a secured area through an object which may be a glass window or the like. The apparatus comprises in the disclosed embodiment, a transmitter transducer secured to the object or panel. This transducer may be a piezoelectric transducer excited from an electrical oscillator. The transducer establishes a supervisory alternating signal in the panel which may be a relatively low frequency ultrasonic signal of a frequency of, for example, 30 kilohertz. A receiver transducer is also secured to the panel for receiving the supervisory signal. A first means couples from the receiver transducer for detecting the absence of the supervisory signal to thereby generate a false condition. The supervisory signal may be lost when, for example, the transducer falls from the panel or is inadequately coupled to the panel.

In a simplified embodiment of the invention, the supervisory means may also be used for detecting a breakage in the glass panel. When the breakage occurs the supervisory signal is interrupted and thus a fault condition is also generated.

In the preferred embodiment, however, a second means is provided coupled from the receiver transducer for detecting a break in the panel and including trigger means and preferably additional digital circuitry. The second means is not triggered by the supervisory signal as this signal is not sufficiently amplified by the second means to cause actuation of the trigger circuit comprising a part of this second means. However, when a break occurs the frequency characteristic of the transducer is such that an increased gain occurs because of the characteristic frequency occasioned by the break. The trigger circuit under this breakage condition triggers and could be used to generate an alarm.

It is desired to use additional discrimination circuitry which is primarily adapted to discriminate between a knock or rap on the glass panel, for example, and an actual cutting or breakage of the glass panel. Because a rap or knock is of short duration and occurs at a very low duty cycle because of human limitations, then a monostable multivibrator may be used and is successively set at its output incrementing a counter if the alarm signal persists above a predetermined precision level for a preselected time interval. If this does occur when the counter reaches a predetermined count, then an alarm condition occurs. On the other hand, if only one pulse occurs because the alarm signal did not persist for a sufficient period of time, then the counter is not incremented sufficiently to cause an alarm condition.

It has been previously mentioned that the supervisory means can be used alone for detection. Similarly, the discriminating means can also be used alone and in addition this digital concept of detection can be used in a passive system wherein no transmitter transducer is used. In such a passive system, of course, the supervisory detection circuitry is not used.

In accordance with another aspect of the present invention there is provided a circuit for detecting an interruption of power or a cutting of the voltage line to the intrusion detection circuit. This detection circuitry includes a bridge circuit and a pair of comparators that can sense a cutting of either voltage line.

Furthermore, in accordance with the present invention, there is provided a unique holder which in the preferred embodiment is for securing both the receiver transducer and the transmitter transducer to the glass panel. The holder is securely fastened to the panel and includes a plate means supporting the transducer which plate means is movable toward the panel. A lubricant is disposed on the transducers and the plate means is moved so the transducers intimately contact the panel with the lubricant disposed between the transducers and the glass panel.

BRIEF DESCRIPTION OF THE DRAWINGS

Numerous other objects, features and advantages of the invention will now become apparent upon a reading of the following detailed description taken in conjunction with the accompanying drawings, in which:

FIG. 2 shows wave forms that are associated with the diagram of FIG. 1;

FIG. 4 is a partial cross-sectional view of a holder for the transducers.

DETAILED DESCRIPTION

Figure 1:
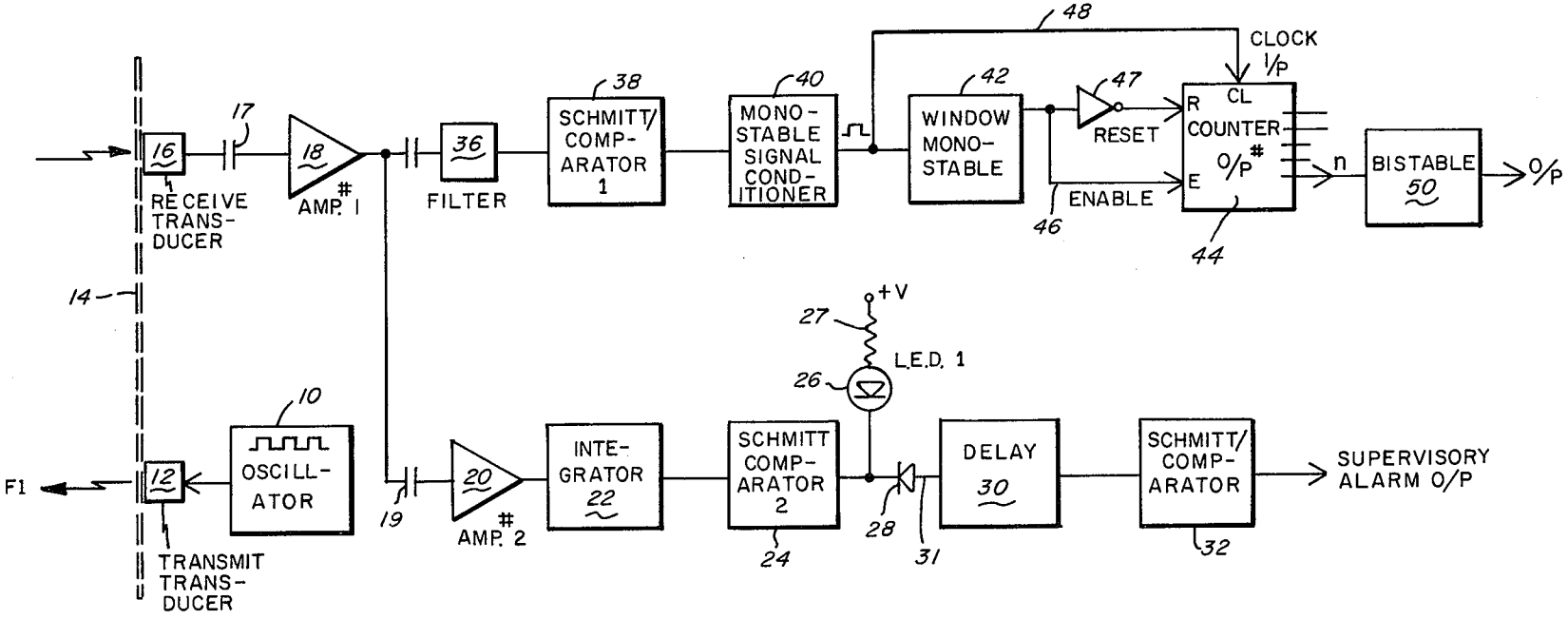
FIG. 1 is a block diagram of one system constructed in accordance with the principles of the present invention.

FIG. 1 shows an oscillator 10 which may be of conventional design and may be a square wave oscillator. The output from oscillator 10 couples to the transmitter transducer 12. Transducer 12 may be a piozoelectric transducer. The oscillator 10 may have an operating frequency on the order of 30 kilohertz for establishing a signal in the panel 14 of frequency F1.

The attachment of transmitter transducer 12 and receiver transducer 16 to the panel 14 is discussed in more detail hereinafter with reference to FIG. 4. The receiver transducer 16 couples by way of capacitor 17 to a first amplifier 18. The output of amplifier 18 couples to two separate branches. One of the outputs from amplifier 18 couples by way of capacitor 19 to a second amplifier 20. The amplifiers 18 and 20 may be of conventional design. The output from amplifier 20 couples to a conventional integrator 22 and the output from the integrator couples to a trigger circuit 24 which may be a combination Schmitt trigger and comparator. The output from trigger circuit 24 couples to light emitting diode 26 and resistor 27, and also by way of diode 28 to a second integrator circuit 30. The output of integrator circuit 30 to a second trigger circuit 32 which may be identical to circuit 24.

The branch including amplifier 20 and integrator 22 is a supervisory circuit. The oscillator 10, as previously mentioned, may have a square wave or sine wave output of constant amplitude or the output from oscillator 10 may be frequency or amplitude modulated. For the sake of simplicity the description assumes that there is no modulation of the output from the oscillator. The output frequency signal F1 is essentially a supervisory signal. Even though the receiver transducer 16 has its frequency characteristics at a peak higher than the supervisory frequency, this transducer 16 does pick up the supervisory signal which is coupled to amplifiers 18 and 20. The output from amplifier 20 couples to an integrator, the output of which is a DC voltage of sufficient amplitude to trigger the circuit 24. When the circuit 24 is triggered, its output is at its high level and thus the light emitting diode 26 is not illuminated.

If the transducer fails or is inadequately coupled or removed from the panel, the signal F1 is no longer received by the receiver transducer 16. When this occurs, the output from integrator 22 decreases to zero and the Schmitt/comparator 24 changes to its quiescent state with its output low thereby causing the light emitting diode 26 to illuminate thus providing a local indication of loss of detection capability with that particular set of transducers.

The circuit 24 is of conventional design and may comprise a well known integrated circuit comparator having a voltage divider at its input. This circuit is maintained in its triggered state as long as an input voltage of sufficient magnitude is present from the output of integrator 22. This circuit essentially triggers when a predetermined voltage is exceeded. As long as the signal F1 is present, the circuit 24 is in its triggered state with the light emitting diode off. It is when the signal F1 is absent that the circuit 24 essentially untriggers causing the light emitting diode 26 to be illuminated.

In an actual system there may be a number of these transducer pairs each of which may couple by way of a diode 28 to a common supervisory line 31. Thus, the low level at the output of the circuit 24 is coupled by way of delay 30 to the main trigger circuit 32 which may be disposed in a remote control unit. The delay 30 is included to prevent false triggering due to large amplitude modulation caused in the transmitting medium by such ambient conditions as wind or vibrations. If the output from circuit 24 remains at its low state for a sufficient period of time, which may be, for example, two seconds, then the device 32 is triggered to signal a supervisory alarm.

The supervisory circuit discussed can also be used to detect a break in the panel 14 which causes an attenuation or loss of the signal F1. If the glass is broken this loss of signal will cause the circuit 24 to operate which in turn operates the circuit 32 at the central control station signaling an alarm condition.

However, where it is desirable to have a very reliable system, and where it is desired to obtain an alarm in an installation where intrusion can occur with negligible attenuation in the transmitting medium, a further discriminating circuit may be used as indicated in FIG. 1. This circuit comprises a filter 36, a trigger circuit 38, monostable multivibrators 40 and 42, and a counter 44.

The filter 36 shown in FIG. 1 tends to block relatively low frequency signals but if a break occurs in the panel 14 as indicated in FIG. 2, a higher frequency signal occasioned by the break is passed by filter 36 to the trigger circuit 38 which may be of the same type as the circuit 24. It is preferred, although not absolutely necessary, that the receiver transducer have a peak response in the area of the frequency occasioned by the breakage. In effect, the transducer 16 may function as a gain device for signals of that particular frequency. As soon as the trigger circuit 38 triggers this signal couples to the monostable multivibrator 40 for similarly triggering this device.

FIG. 2 shows two different conditions that can occur. In the first part of FIG. 2 the panel is subjected to successive knocks but the panel is not broken. In the second portion of FIG. 2 the glass has been broken. In the case of a rap or knock the trigger circuit 38 is operated and may have its output high between times T1 and T2 as shown in FIG. 2. On the other hand, if the panel is broken then the signal to the device 38 is above its threshold level 39 for a longer period of time. FIG. 2 shows the output from the monostable multivibrator 40 which has a fixed predetermined pulse width.

As soon as the multivibrator 40 is triggered, so also is the multivibrator 42. FIG. 2 shows the wave form from the multivibrator 42 which forms a window having a pulse width that is greater than the pulse width output from the monostable multivibrator 40. The output from multivibrator 42 couples by way of line 46 to the enable input of counter 44. The output from the multivibrator 42 also couples by way of inverter 47 to the reset input of the counter 44. The counter 44 is clocked by way of line 48 directly from the output of the monostable multivibrator 40. Thus, the counter 44 is enabled by way of line 46 as long as the output from the multivibrator 42 is at its high state as indicated in FIG. 2. If only a single pulse from multivibrator 40 occurs, then the counter is only incremented once. On the other hand, if the second condition shown in FIG. 2 exists then a number of pulses occur at the output of the multivibrator 40 and the counter 44 is incremented to a count of three as illustratively shown in FIG. 2. The bistable alarm device 50 shown in FIG. 1 is coupled to one of the count outputs of the counter. The device 50 is operated only when the counter reaches a sufficient count which may, for example, be a count of three as illustratively shown in FIG. 2. Thus, the circuitry including the multivibrators and the counter 44 effectively discriminates between a knocking or rapping on the glass and a breakage in the glass. It has been found by experiment that it is impossible for a human to rap or knock the glass at a fast repetition rate. The pulse width from monostable multivibrator 42 can easily be controlled so that this pulse width is less than any possible rapping frequency. Furthermore, the output pulse width from the monostable multivibrator 40 may also be controlled to generate any number of pulses during the window established by multivibrator 42. Each time that the window pulse terminates the counter is reset by way of inverter 47 and if the counter has not incremented to a sufficient count, then no alarm condition is generated. On the other hand, if the counter increments to the predetermined count then the bistable device 50 is operated and an alarm occurs.

Figure 3:
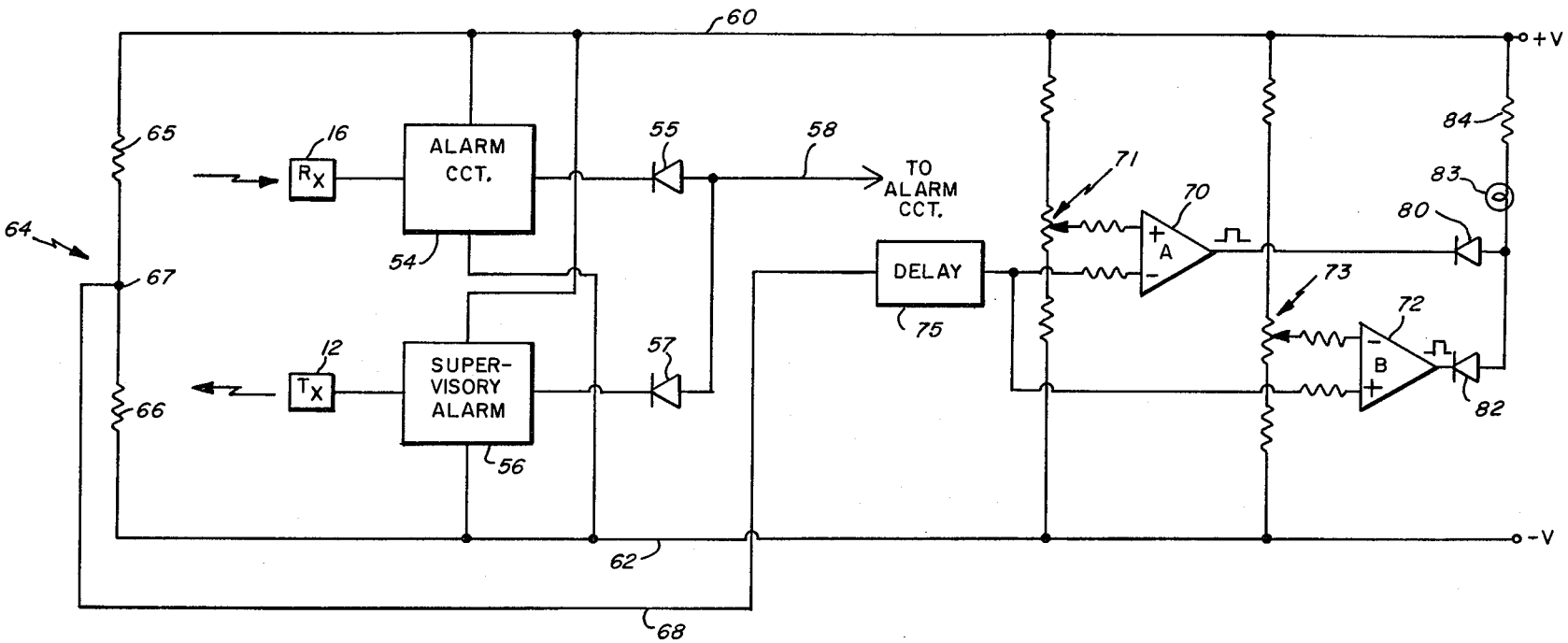
FIG. 3 shows another embodiment of the present invention in a circuit block diagram.

Referring now to FIG. 3, like reference characters will be used to identify like components shown in FIG. 1. FIG. 3 shows the transmitter transducer 12 and the receiver transducer 16 both of which may be piezoelectric transducers which couple to the glass window or panel. The alarm circuit 54 shown in FIG. 3 may comprise the filter 36, trigger circuit 38 and monostable multivibrator 40. The supervisory circuit 56 shown in FIG. 3 may comprise the amplifier 20, integrator 22 and trigger circuit 24. In the embodiment shown in FIG. 3 the output from the alarm circuit 54 reverts to a low level when a breakage occurs. Similarly, if the supervisory signal is lost the output of circuit 56 also reverts to its low level. The diodes 55 and 57 form an OR circuit with the output signal on line 58 going to a low level if either of the circuits 54 or 56 or both of them indicate a fault condition.

It is noted in FIG. 3 that each of the circuits 54 and 56 have voltage lines that couple to the +V line 60 and the −V line 62. A resistor divider 64 including resistors 65 and 66 also couple between the lines 60 and 62. The common node 67 between the resistors 65 and 66 couples by way of line 68 to the comparators 70 and 72. The network 64 senses a break or interruption in the lines 60 or 62. Under normal operating conditions the line 68 is at a fixed voltage determined by the resistors 65 and 66 and the comparators 70 and 72 are not operated. The comparator 70 has one input coupled to a resistor string 71 for biasing its positive (+) input at say +9 volts. On the other hand the comparator 72 has an input coupled to a resistor string 73 for biasing its negative (−) input at say +7 volts. The input to the comparators taken from output line 58 which couples to line 68 passes through delay 75 to line 77 which couples to the active input of each of the comparators 70 and 72. As long as the voltage lines 60 and 62 are coupled to the divider 64 the voltage on line 68 which may be adjusted to be, for example, +8 volts does not operate either of the comparators. However, if one of the lines 60 or 62 is interrupted then the voltage on line 68 either increases or decreases depending upon which line has been cut. In either case one of the comparators 70 or 72 will have a high output. The output from the two comparators is coupled by way of diodes 80 and 82 to a light emitting diode 83 and resistor 84. The diodes 80, 82 and 83 and the resistor 84 form an OR circuit wherein if either of the comparators has a low level input because of a detection of a breakage in one of the lines 60 or 62 then the corresponding diode 80 or 82 conducts and illuminates the diode 83. The output from the anodes of diodes 80 and 82 may also couple to a flip-flop, for example, for operating another type of signaling device for indicating this fault condition. In FIG. 3 the delay 75 is provided simply as a filter or integrator that requires that any voltage changes be more than just transient. The delay 75 functions to prevent false alarm conditions and false detections by the comparators 70 and 72.

FIG. 4 shows in a partial cross-sectional view a holder 86 which may be in the form of a square or rectangular box. The holder 86 has side walls 87 and a base 88 defining apertures 89 and 90 for respectively receiving the transmitter transducer 12 and the receiver transducer 16. FIG. 4 also shows the glass panel 14. The holder 86 is secured to the panel 14 by means of a double sided tape 92 which secures the base 88 to the surface of the panel 14. The board 94 is disposed in the holder 86. This board may be a printed circuit board for holding many of the components of the device and also is shown holding the transducers 12 and 16. The holder also comprises another board 96 which is fixed relative to the walls 87. The board 94 is movable relative to the walls 87 and is only limited by the stop 95. A pair of screws 97 are threadedly engaged with the board 96 and urged against the board 94 for forcing the transducers 12 and 16 against the panel 14.

Prior to affixing the holder 86 to the panel a lubricant 98 is deposited on the end of each of the transducers. This lubricant may be a silicon lubricant that is maintained in a soft state. As the board 94 is moved toward the panel 14 the transducers intimately contact the panel but have the lubricant 98 deposited therebetween. If the panel 14 expands for any reason, the transducers are not tensioned and can slide relative to the panel by means of the lubricant that they are engaged with. In this way false frequencies are not established as is the case when the transducers are fixedly secured to the panel such as with the use of an epoxy glue.

What is claimed is:

1. Apparatus for detecting an intrusion into a secured area through a breakable material comprising;

transmitter transducer means secured to the material for establishing a supervisory alternating signal in the material, receiver transducer means secured to the material for receiving the supervisory signal, first detector means coupled from said receiver transducer means for detecting the absence of the supervisory signal to generate a fault signal, and second detector means coupled from said receiver transducer means for detecting a break in the material and generating a breakage signal and including trigger means responsive to the breakage signal reaching a predetermined threshold level for providing an intermediate signal having a trigger level persisting for as long as the threshold level is maintained, and means coupled from the trigger means and responsive to the intermediate signal persisting for at least a fixed predetermined period of time and independent of the amplitude of the breakage signal for generating an alarm signal.

2. Apparatus as set forth in claim 1 wherein said first detector means includes a trigger circuit that operates from one state to another when the supervisory signal is absent.

3. Apparatus as set forth in claim 2 wherein said first detector means further includes an amplifier means and an integrator means coupled between the receiver transducer means and trigger circuit.

4. Apparatus as set forth in claim 1 wherein said second detector means includes a first monostable multivibrator and a second multivibrator and a counter coupled from the second multivibrator, said first multivibrator generating pulses of predetermined width as long as the breakage signal persists, and the second multivibrator has an output that enables the counter, which is incremented to a predetermined count generating an alarm if the breakage signal persists for a sufficiently long period.

5. Apparatus as set forth in claim 1 wherein said means responsive to the intermediate signal includes a first two-state means having an output of fixed duration less than the predetermined period and commencing with the breakage signal, and a second two-state means having an output of the predetermined period, and means responsive to more than one pulse from said first two-state means during the predetermined period for generating the alarm condition.

6. Apparatus as set forth in claim 5 wherein said means for generating an alarm includes a counter means having a clock input coupled from the first two-state means and an enabling input coupled from the second two-state means.

7. A system for detecting the breakage or cutting of a glass panel or the like comprising;

a receiver transducer coupled to the panel and responsive to a breakage signal having components at random frequencies, first detector means coupled from said receiver transducer and responsive to the magnitude of said breakage signal reaching a predetermined threshold level for providing an intermediate signal having a decision level persisting for as long as the threshold level is attained, and second detector means coupled from said first detector means and responsive to said intermediate signal persisting for at least a fixed predetermined period of time and independent of the amplitude of the breakage signal for generating an alarm.

8. A system as set forth in claim 7 wherein said second detector means comprises a first monostable means having an output of fixed duration and commencing concurrent with the commencement of the breakage signal, a second monostable means having an output of the predetermined period of time and a counter responsive to more than one pulse from said first monostable means during the predetermined period of time for generating the alarm condition.

9. A system as set forth in claim 8 wherein each monostable means includes a monostable multivibrator.

10. A system as set forth in claim 6 wherein said second detector means includes a first two-state means having an output of fixed duration less than the predetermined period and commencing with the breakage signal, and a second two-state means having an output of the predetermined period, and means responsive to more than one pulse from said first two-state means during the predetermined period for generating the alarm condition.

11. In a system for detecting breakage or cutting of a glass panel or the like having at least one transducer for coupling to the panel, the improvement comprising;

a holder for the transducer, means for fixedly securing the holder to the panel, movable means in the holder for holding the transducer with the transducer extending through the holder, said movable means moving relative to the holder to urge the transducer into contact with the panel.

* * * * *